US005538403A

United States Patent [19]

Black

[11] Patent Number: 5,538,403

[45] Date of Patent: Jul. 23, 1996

[54] HIGH PRESSURE PUMP FOR FUEL INJECTION SYSTEMS

[75] Inventor: John W. Black, Columbus, Ind.

[73] Assignee: Cummins Engine Company, Inc., Columbus, Ind.

[21] Appl. No.: 238,848

[22] Filed: May 6, 1994

[51] Int. Cl.[6] ..... F04B 53/10

[52] U.S. Cl. ..... 417/253; 417/531

[58] Field of Search ..... 417/62, 253, 254, 417/265, 286, 307, 521, 531, 539; 123/456

[56] References Cited

U.S. PATENT DOCUMENTS

| | | | |
|---|---|---|---|
| 2,274,224 | 2/1942 | Vickers | 417/254 |
| 4,236,877 | 12/1980 | Curtis | 417/265 |
| 4,431,160 | 2/1984 | Burt et al. | 251/86 |
| 4,502,445 | 3/1985 | Roca-Nierga et al. | 123/458 |
| 4,681,513 | 7/1987 | Saito et al. | 417/265 |
| 4,777,921 | 10/1988 | Miyaki et al. | 123/456 |
| 4,905,960 | 3/1990 | Barnhart | 251/129.18 |
| 5,035,221 | 7/1991 | Martin | 123/451 |
| 5,058,553 | 10/1991 | Kondo et al. | 123/456 |
| 5,094,216 | 3/1992 | Miyaki et al. | 123/506 |
| 5,109,822 | 5/1992 | Martin | 123/456 |
| 5,133,645 | 7/1992 | Crowley et al. | 417/279 |
| 5,197,438 | 3/1993 | Yamamoto | 123/456 |
| 5,230,613 | 7/1993 | Hilsbos et al. | 123/456 |
| 5,277,156 | 1/1994 | Osuka et al. | 123/198 DB |
| 5,364,240 | 11/1994 | Salecker | 417/427 |
| 5,404,855 | 4/1995 | Yen et al. | 123/446 |

FOREIGN PATENT DOCUMENTS

| | | | |
|---|---|---|---|
| 3-138465 | 6/1991 | Japan | 717/62 |

*Primary Examiner*—Peter Korytnyk
*Attorney, Agent, or Firm*—Sixbey, Friedman, Leedom & Ferguson; Charles M. Leedom, Jr.; Tim L. Brackett, Jr.

[57] ABSTRACT

A variable displacement high pressure pump for pumping fluid at a high pressure to an accumulation chamber is disclosed including a low pressure supply pump for supplying fluid at a low pressure, a first high pressure pumping unit for receiving the low pressure fluid through an inlet and selectively delivering the supply fluid to the accumulation chamber at a high pressure greater than the low pressure, a second high pressure pumping unit for receiving the low pressure fluid through an inlet and selectively delivering the supplied fluid to the accumulation chamber at a pressure greater than the low pressure, a common fluid passage in fluid communication with each of the first and second high pressure pumping units for permitting the flow of fluid from one of the first and second high pressure pumping units to the other of the first and second high pressure pumping units and a pressure balanced valve positioned in the common fluid passage for selectively blocking the flow of fluid between the first and second high pressure pumping units such that one of the first and second high pressure pumping units delivers fluid at the high pressure to the accumulation chamber when the valve blocks the flow of fluid between the first and second high pressure pumping units.

27 Claims, 6 Drawing Sheets

HIGH PRESSURE PUMP FOR FUEL INJECTION SYSTEMS

FIELD OF THE INVENTION

The present invention relates to variable discharge high pressure pumps for supplying metered quantities of fuel to an accumulation chamber of a diesel engine fuel system. More particularly, the present invention relates to a system for maintaining a pressure of the fuel in the accumulation chamber at a predetermined optimum value.

BACKGROUND OF THE INVENTION

Conventional variable displacement high pressure pumps typically have a plurality of pumping elements, each of which comprises a pumping chamber in which a pumping plunger is reciprocated by a rotary cam, with fuel being supplied to it at a low pressure (approximately 40 psi) by a low pressure pump. Examples of such high pressure pumps can be found in, for example, U.S. Pat. Nos. 5,133,645; 5,094,216; 5,058,553; 4,777,921 and 4,502,445.

Furthermore, commonly a high pressure pump will have two to four pumping elements, depending upon the pumping capacity, and a respective solenoid valve is used to control the quantity of fuel metered into each of the pumping units. For costs and other related reasons, it is desirable to enable metering of the fuel into the pumping chambers of the plurality of pumping units to be controlled by no more than a single solenoid valve. In operation, conventional variable displacement high pressure pumps maintain the solenoid valves in a normally open position such that fuel flows into and fills the pumping chambers during the retraction stroke of the pumping plunger. When the pumping plunger starts its compression stroke, fuel spills back through the open solenoid valve until it receives a command signal to close. At that point, the fuel remaining in the pumping chamber is trapped and pressurized by the pumping plunger which causes the fuel to flow at high pressure into a common rail which is connected directly to a plurality of injectors or to an accumulator which may be sequentially connected to the engine injectors through a distribution valve. This being generally known as a variable start, constant stop of injection pump.

U.S. Pat. Nos. 5,109,822 and 5,035,221 disclose high pressure common rail fuel injection systems for diesel engines in which a pair of pumping elements are controlled by a single solenoid valve. However, both of the pumping elements of the pair that are controlled by the same solenoid valve are filled and discharged in unison. Accordingly, to enable fuel to be supplied to the common rail when that pair of pumping elements are being filled, a second pair of pumping elements are provided which are controlled by a second solenoid valve. Therefore, it is desirable to achieve a manner of controlling a plurality of pumping elements by way of a single solenoid valve which would enable the pumping elements to be supplied with fuel at different times and preferably 180° out of phase from one another.

In an effort to overcome the above noted shortcomings, U.S. application Ser. No. 057,510 filed May 6, 1993 and assigned to the assignee of the subject invention, the contents of which are hereby incorporated herein by reference, discloses a variable displacement high pressure pumping system which includes a plurality of high pressure pumping elements which receive fuel from a low pressure fuel pump with each pumping unit having a rotary cam driven roller tappet, for producing pumping displacement of the pumping plunger of the pumping element which is connected to a respective pumping plunger by a separated link in a manner permitting the pumping plunger to float relative to the roller tappet during at least a portion of each pumping cycle thereby enabling the capacity of the pumping chamber to be limited to an extent that is less than the full stroke achievable by the pumping plunger. In this manner, the quantity of fuel to be pressurized and injected into the accumulation chamber does not have to be determined by a cutting off of a spilling flow of excess metered fuel during the compression stroke of the pumping plunger. Consequently, a low pressure solenoid valve can be used. In operation, the pumping plunger is caused to move downwardly due to a pressure differential so that fuel may be metered into a pumping chamber by way of a fuel supply line and when the electronic control unit determines that a prescribed quantity of fuel has been metered into the pumping chamber, a command signal is generated to permit low pressure fuel to be pumped to an underside of the pumping plunger thereby equalizing the pressure on both sides of the pumping plunger and consequently bringing such plunger to rest despite continued downward movement of a link plunger. Accordingly, it is necessary to ensure that the pumping plunger 3 is stopped at the exact position necessary to control the amount of fuel which is to be pumped into an accumulation chamber.

In an alternative embodiment, fuel is metered to the pumping chamber by a solenoid valve and when it is determined by an electronic control unit that a requisite amount of fuel has been metered into the pumping chamber, the solenoid valve will close. Therefore, when the pumping plunger is contacted by a tappet, the predetermined metered amount of fuel will be pressurized and passed to the accumulation chamber. However, in each of the several embodiments, the electronic solenoid valve is used merely for metering a predetermined amount of fuel into the pressure chamber which is subsequently pressurized and directed to the accumulation chamber. Further, any overflow or bypass flow of fuel is returned to the fuel supply and must be re-pumped by the low pressure pump to the pumping chamber with each of the pumping units acting independently of one another. Moreover, it is essential that the electronic control valve supplying fuel to the pumping chamber be timed to the operating cycle of the respective pumps, that is, it is necessary to time the operating cycle of the solenoid valve to the pumping cycle.

Accordingly, there is clearly a need for a high pressure pump for a fuel injection system where a plurality of high pressure pumping units maintain a pressure of fuel in an accumulation chamber at a predetermined optimum value. Further, there is a need for a high pressure pumping unit wherein at least two related pumping units can operate essentially 180° out of phase with a single control valve being operated in accordance with a pressure sensed in the accumulation chamber rather than timing the operation cycle of the control valve to that of the pumping cycle.

SUMMARY OF THE INVENTION

A primary object of the present invention is to overcome the above noted shortcomings associated with conventional pumping units.

A further object of the present invention is to provide a high pressure pump for a fuel injection system wherein the pressure of the fuel in a accumulation chamber is maintained at a predetermined optimum value.

Yet another object of the present invention is to provide a high pressure pumping system wherein at least two pumping units can operate either in unison with one another but 180° out of phase or independently depending upon the pressure of fuel accumulated in the accumulation chamber.

Yet another object of the present invention is to provide a high pressure pumping system wherein a fluid is pumped to an accumulation chamber by a plurality of pumping units which are controlled by a single solenoid operated valve.

An additional object of the present invention is to provide a high pressure pumping system where fluid not pumped by one pumping unit to an accumulation chamber is passed to a second pumping unit without being returned to a supply tank.

A further object of the present invention is to provide a high pressure pumping system for an internal combustion engine wherein each pumping unit of the pumping system undergoes a complete pumping cycle regardless of the amount of fuel being pumped at a high pressure to an accumulation chamber.

A further object of the present invention is to provide a high pressure pumping system wherein each pumping unit of the pumping system is interconnected with another pumping unit of the pumping system such that fuel not pressurized and passed to an accumulation chamber is passed between the respective pumping units.

These as well as additional objects of the present invention are achieved by providing a variable displacement high pressure pump for pumping fluid at a high pressure to an accumulation chamber including a low pressure supply pump for supplying fluid at a low pressure, a first high pressure pumping unit for receiving the low pressure fluid through an inlet and selectively delivering the supply fluid to the accumulation chamber at a high pressure greater than the low pressure, a second high pressure pumping unit for receiving the low pressure fluid through an inlet and selectively delivering the supplied fluid to the accumulation chamber at a pressure greater than the low pressure, a common fluid passage in fluid communication with each of the first and second high pressure pumping units for permitting the flow of fluid from one of the first and second high pressure pumping units to the other of the first and second high pressure pumping units and a pressure balanced control valve positioned in the common fluid passage for selectively blocking the flow of fluid between the first and second high pressure pumping units such that one of the first and second high pressure pumping units delivers fluid at the high pressure to the accumulation chamber when the valve blocks the flow of fluid between the first and second high pressure pumping units.

Alternatively, the above noted objects can be achieved by providing a pumping system for maintaining a high fluid pressure within an accumulation chamber with the system including a plurality of high pressure pumping units for delivering fluid to the accumulation chamber at a high pressure, a fluid supply pump for supplying fluid at a low pressure to an inlet of each of the plurality of high pressure pumps, a common fluid chamber fluidically connected to an outlet of each of the high pressure pumps with the common fluid chamber having a first outlet fluidically connected to the accumulation chamber and a second outlet fluidically connected to each inlet of the plurality of high pressure pumps and a pressure balanced control valve positioned in the second outlet for selectively blocking the flow of fluid from the common fluid chamber to the plurality of high pressure pumps such that fluid is delivered at a high pressure to the accumulation chamber when the valve blocks the flow of fluid from the second outlet of the common fluid chamber.

These as well as additional advantages of the subject invention will become apparent from the following detailed description when read in light of the several figures.

DETAILED DESCRIPTION OF THE PREFERRED EMBODIMENTS

Figure 1A:
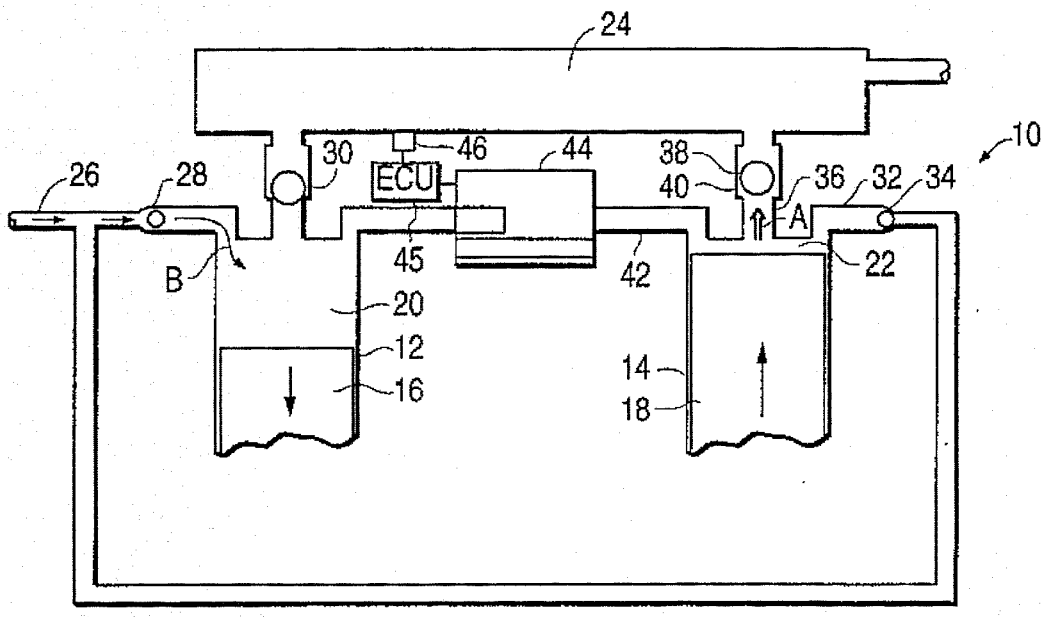
FIGS. 1A, 2A, 3A and 4A are schematic illustrations of a high pressure pumping system in accordance with the present invention illustrating the cyclic operation thereof.

Referring now to the several figures and particularly FIGS. 1A, 2A, 3A and 4A, a first embodiment of the present invention will now be described in greater detail. As is schematically illustrated in FIG. 1A, the high pressure pumping system 10 of the present invention includes at least two pumping units 12 and 14 which include reciprocable pumping elements 16 and 18, respectively. The pumping elements are reciprocated by way of a rotatable cam and follower, not illustrated, in a conventional manner so as to impart cyclic displacement of the pumping elements 16 and 18. The particular cam and follower arrangement is not illustrated because such arrangements are generally known. It is preferred to reciprocate pumping elements 16 and 18 180° out of phase so that one element is executing a retraction (filling) stroke while the other is executing an advancement (pumping) stroke and vice versa. Each of the pumping units 12 and 14 include a pumping chamber 20 and 22, respectively, wherein fluid preferably in the form of fuel is pressurized and selectively passed to an accumulation chamber 24 for subsequent injection into the cylinders of an internal combustion engine. As is illustrated in FIG. 1A, fuel is supplied through the supply line 26 in a conventional manner from a low pressure supply pump (not shown) at a pressure in the range of 100–400 psi and preferably approximately 300 psi, wherein the fuel passes through a check valve in the form of ball valve 28 and into the pumping chamber 20 of the pumping unit 12. It should be noted that the ball valve 30 is in the closed position until such time as the fluid pressure in the pumping chamber 20 exceeds that of the accumulation chamber 24. Similarly, the pumping unit 14 includes an inlet 32 which accommodates check valve 34 for permitting the passage of supply fluid into the pumping chamber 22.

With the cyclic stroke illustrated in FIG. 1A, the pumping unit 14 is illustrated as supplying pressurized fluid to the accumulation chamber 24 through passage 36 in that the pressure of the fluid within the pumping chamber 22 is greater than that in the accumulation chamber 24 and consequently displaces the ball 38 of check valve 40. It should be noted that a common fluid passage 42 is provided between each of the pumping units 12 and 14 for the passage of fluid therebetween. Further, positioned within the common fluid passage 42 is a control valve 44 for selectively blocking the flow of fluid through the common passage 42. The control valve 44 is preferably a pressure balanced solenoid valve of the type set forth in U.S. Pat. No. 4,905,960 issued to Barnhart et al. or copending U.S. application Ser. No. 041,424, filed Mar. 31, 1993, each assigned to the assignee of the subject invention, the contents of which are incorporated herein by reference. Therein, the flow of fluid through the valve is controlled by an electronic actuator which attracts an armature and selectively closes off the passage of fluid therethrough. While any three-way solenoid actuated valve may be incorporated into the system illustrated in FIG. 1A, it is preferred that such solenoid actuated valve be pressure balanced and capable of passing fluid equally in either direction, the significance of which will become apparent from the following description.

Operation of the control valve 44 is regulated by an electronic control unit 45 in response to the pressure of the accumulation chamber 24 sensed by pressure sensor 46. This pressure sensor may be of any known type. Although the disclosed feedback control is electronic, a hydraulic feedback could be used as well.

It should be noted from FIG. 1A that the cyclic operation of each of the pumping units 12 and 14 are essentially 180° out of phase with the pumping element 16 retracting as the pumping element 18 advances to displace the fluid within the pumping chamber 22. During the retraction of the pumping element 16, fluid from the low pressure pumping system (not shown) flows into the pumping chamber 20 past the check valve 28. If the pressure sensor 46 determines that the pressure of fluid within the accumulation chamber 24 has fallen below a predetermined level, electronic control unit 45 will cause control valve 44 to move to its closed position wherein fluid within the pumping chamber 22 is pressurized and passed to the accumulation chamber 24 through check valve 38. The flow of high pressure fluid being illustrated by the double arrow A while the flow of low pressure fluid is illustrated by the single arrow B. The predetermined optimum fluid pressure of the accumulation chamber 24 being in the range of 5,000 psi to 30,000 psi and preferably in the range of 16,000 psi to 22,000 psi.

Figure 2A:
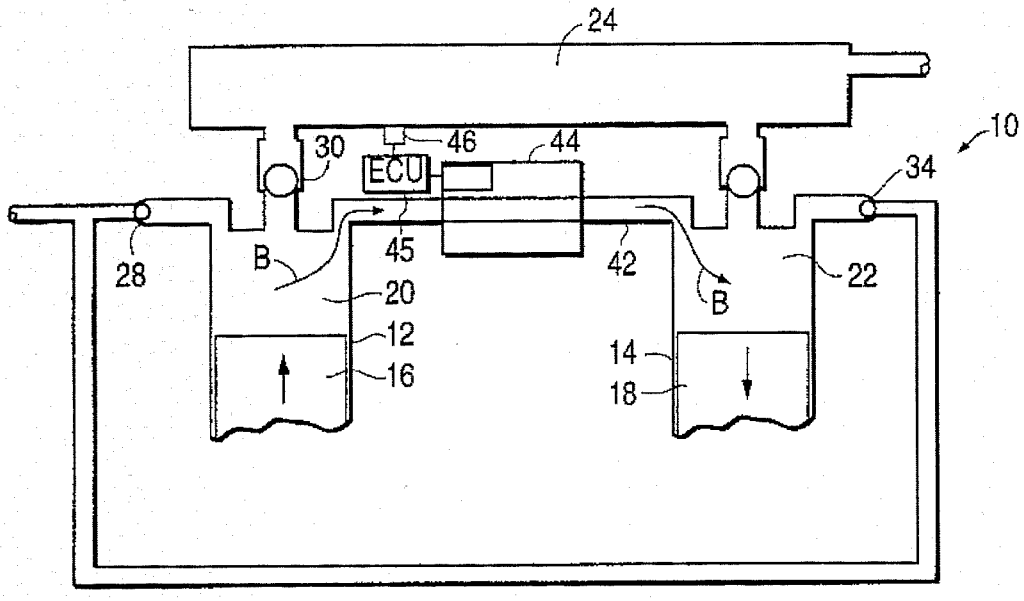

Referring now to FIG. 2A, the pressure sensor 46 has determined that the pressure of fluid within the accumulation chamber 24 is at or exceeds the predetermined optimum level and consequently the control valve 44 is moved to the open position wherein fluid communication between pumping units 12 and 14 through the common passage 42 is restored. Accordingly, continued upward movement of the pumping element 16 forces fluid in the pumping chamber 20 to pass through the common passage 42 and into the pumping chamber 22 of pumping unit 14 due to the downward stroke of pumping unit 18. As can be seen from FIG. 2A, each of check valves 28 and 34 are in the closed position and no additional fuel is supplied to either of the pumping chambers from the low pressure pumping system (not shown). Similarly, because the fluid in pumping chamber 20 is permitted to pass to pumping chamber 22, the check valve 30 remains seated in that the pressure of the fluid within the pumping chamber 20 is not greater than that of the pressure within the accumulation chamber 24.

Figure 3A:
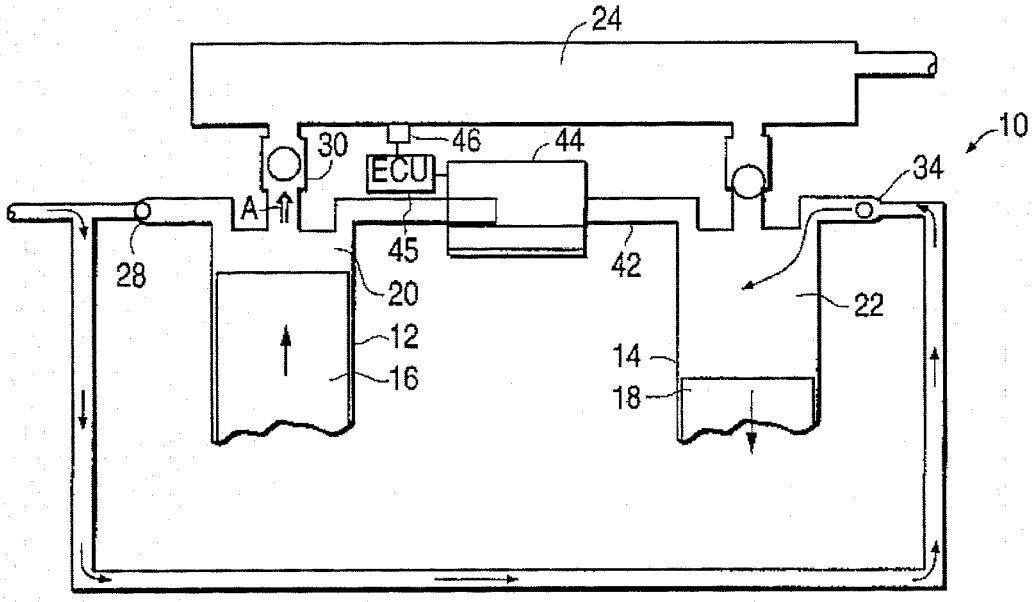

If it is determined by electronic control unit 45 that the pressure in the accumulation chamber 24 has dropped below its predetermined value in response to the pressure sensed by the pressure sensor 46 during the upward stroke of the pumping element 16 of pumping unit 12, the electronic control unit 45 will actuate the control valve 44 to move the valve to the closed position as illustrated in FIG. 3A thus pressurizing the fluid in the pumping chamber 20 and passing such fluid past check valve 30 and into the accumulation chamber 24. This being illustrated by the double arrow A. When the pumping unit 12 is pumping pressurized fluid to the accumulator 24, fluid at a supply pressure of 100 to 400 psi is delivered through passage 48 to the inlet 32 of pumping unit 14 past check valve 34 thus filling the pumping chamber 22 with fluid during the downward stroke of the pumping element 18. If the electronic control unit 45 determines that the fluid pressure within the accumulation chamber 24 is sufficient in response to the pressure sensed by the pressure sensor 46, the electronic control unit 45 will position the control valve 44 to remain in the open position thus permitting the fluid within the respective pumping chambers 20 and 22 to pass back and forth through the common passage 42 until such time as the pressure sensor 46 notes a reduction in the fluid pressure within the accumulation chamber 24. At which time, the control valve 44 would be moved to the closed position by the electronic control unit 45 and whichever pumping element was in its upward stroke would pass high pressure fluid to the accumulation chamber 24.

Figure 4A:
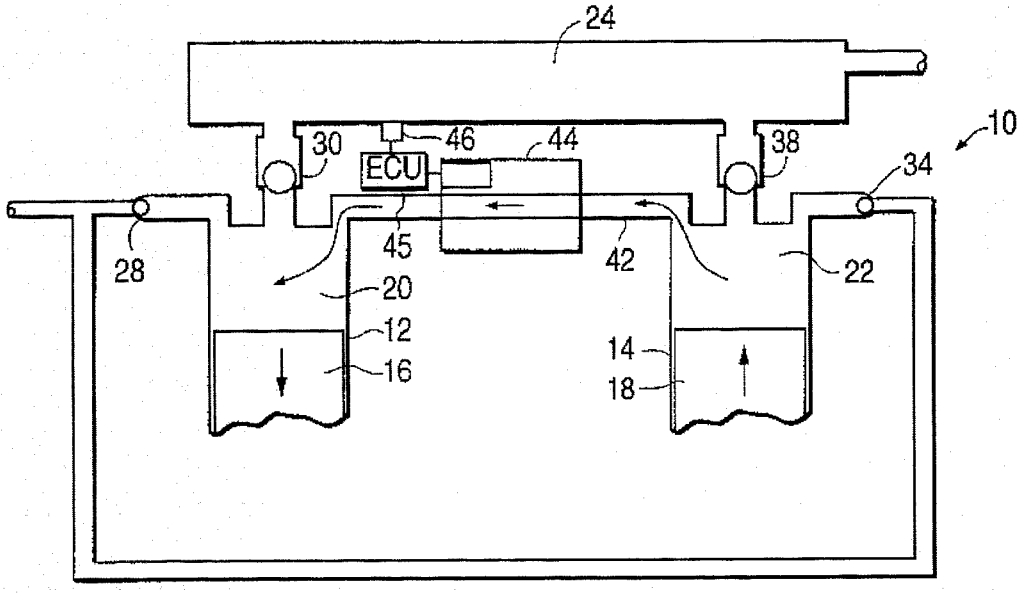

With reference to FIG. 4A, the pumping system is illustrated as being in a passive condition similar to that illustrated in FIG. 2A; however, it is the pumping element 18 of pumping unit 14 which is on the upward stroke and passes fluid through common passage 42 to the pumping chamber 20 of pumping unit 12. Again because the pressure of the fluid within either of the pumping chambers 20 or 22 is not greater than that in the accumulation chamber 24, the check valves 30 and 38 remain in place, thus passing the fluid between pumping chambers 20 and 22 by way of common passage 42. Further, no additional fluid is supplied by the low pressure pumping system (not shown) through check valves 28 and 34 in that the pressure of the fluid within the pumping chambers 20 and 22 is greater than that supplied by the low pressure pumping system. Again, once it is determined by the electronic control unit in response to the pressure sensed by the pressure sensor 46 that the fluid pressure within the accumulation chamber 24 has dropped below the predetermined optimum value, the electronic control unit 46 will actuate control valve 44 to move the valve to the closed position thus pressurizing the fluid in either pumping chamber 20 or 22 dependent upon which of the pumping elements 16 and 18 are on their upward stroke thus passing such pressurized fluid into the accumulation chamber 24 past check valve 30 or 38.

Accordingly, when the control valve 44 is in the open condition, fuel is allowed to flow back and forth between the two pumping chambers. There is no inlet flow from the low pressure pumping system nor is there any exit flow to the accumulation chamber 24, thus the pumps operate in unison with one another in a passive mode. Alternatively, when the control valve 44 is closed by the electronic control unit 45, each of the pumping units 12 and 14 operate independently of one another. In either case, it is not necessary to time the operating cycle of the control valve to the pumping cycle as with known pumping systems. The control valve 44 is closed by the electronic control unit when the pressure sensor 46 senses a fluid pressure below the predetermined optimum value regardless of the position of the pumping elements.

While the above noted operation of the pumping system operates the control valve 44 in response to a predetermined low pressure limit of the accumulation chamber 24, the electronic control unit may alternatively command the control valve to open and close in response to other desirable factors. For instance, in a fuel system a small amount of fuel will be removed from the accumulation chamber during every injection event. Moreover, each injection event occurs at the same frequency as the pumping events. Therefore, the accumulation chamber may be sized such that each event will have only a minor impact on the internal pressure of the accumulation chamber. Accordingly, in such a fuel system, the pumping units will normally pump at least a portion of their full volume on each stroke with the electronic control unit 45 being designed to alter the portion of the pump volume which is to be delivered to the accumulation chamber by controlling control valve 44 based on an average accumulation chamber pressure. As the actual pressure falls below a target average pressure, a proportionately larger amount of fuel will be pumped to the accumulation chamber 24.

With such a system, by using a pressure balanced control valve, the control valve 44 can be opened and closed during any portion of the pumping event. As discussed previously, the pumping elements are driven by a rotatable cam having a predetermined cam profile which displaces the pumping element two or more times per rotation. As is known with conventional cam profiles, they generally initiate and terminate forward displacement of the pumping element at a low velocity. Accordingly, the control valve 44 can be closed early in the pumping event so that pumping begins on a low velocity portion of the pumping stroke which reduces instantaneous loading of the system, or the control valve 44 can be closed late in the pumping event such that pumping ends on a low velocity portion of the pumping stroke thus reducing system noise. The particular timing for closing of the control valve will depend first on the amount of fuel required to achieve the desired pressure within the accumulation chamber and second on the operating characteristics desired.

Referring now to FIGS. 1B, 2B, 3B and 4B, a high pressure pumping system in accordance with an alternative embodiment of the present invention will be described in greater detail.

The high pressure pumping system 110 includes pumping units 112 and 114 which accommodate pumping elements 116 and 118 respectively. As with the previous embodiment, the space above the pumping elements 116 and 118 form pumping chambers 120 and 122, respectively. Each of these pumping chambers being provided to pressurized fluid so as to maintain the pressure of the fluid in an accumulation chamber 124 at a predetermined optimum value. This optimum value being the same as that of the previous embodiment. The high pressure pumping system 110 includes a supply passage 126 for supplying fluid to either pumping unit 112 or pumping unit 114 from a low pressure pumping system (not shown). The low pressure fluid passes through passage 127, bypasses check valve 128 into the pumping chamber 120. With the particular operation cycle illustrated in FIG. 1B, the pumping unit 114 is in the process of pumping fluid at a high pressure from the pumping chamber 122 to the accumulation chamber 124. This being illustrated by double arrow A. In order to assure that no high pressurized fluid is passed into the pumping chamber 120, a check valve 130 is provided. As can be seen from the pumping system 110, this pumping system differs from that illustrated in FIG. 1A in that a common pressure chamber 132 is provided between the pumping units 112 and 114 with only a passage 131 and single check valve 134 being provided between the common chamber 132 and accumulation chamber 124. Return flow from the common passage 132 to either pumping chamber 120 or 122 being restricted by the check valves 130 and 136.

The common chamber 132 includes two outlets, one being outlet 138 to the accumulation chamber 124 and the second being outlet 140 which passes to the fluid supply and the pumping chambers 120 and 122. Positioned within the passage 140 is a pressure balanced control valve 144 which is preferably of the type discussed hereinabove. Unlike the pressure balanced control valve 44 illustrated in FIG. 1A, the pressure balanced control valve 144 need only pass fluid in one direction and consequently need not be designed so as to equally pass fluid in either direction, thus resulting in a control valve of reduced cost. As with the previous embodiment, a pressure sensor 146 is provided for sensing the pressure of fluid within the accumulation chamber 124 and an electronic control unit 145 is provided for determining the position of the pressure balanced control valve 144 in accordance with the fluid pressure of the accumulation chamber 124 sensed by the sensor 146.

Figure 1B:
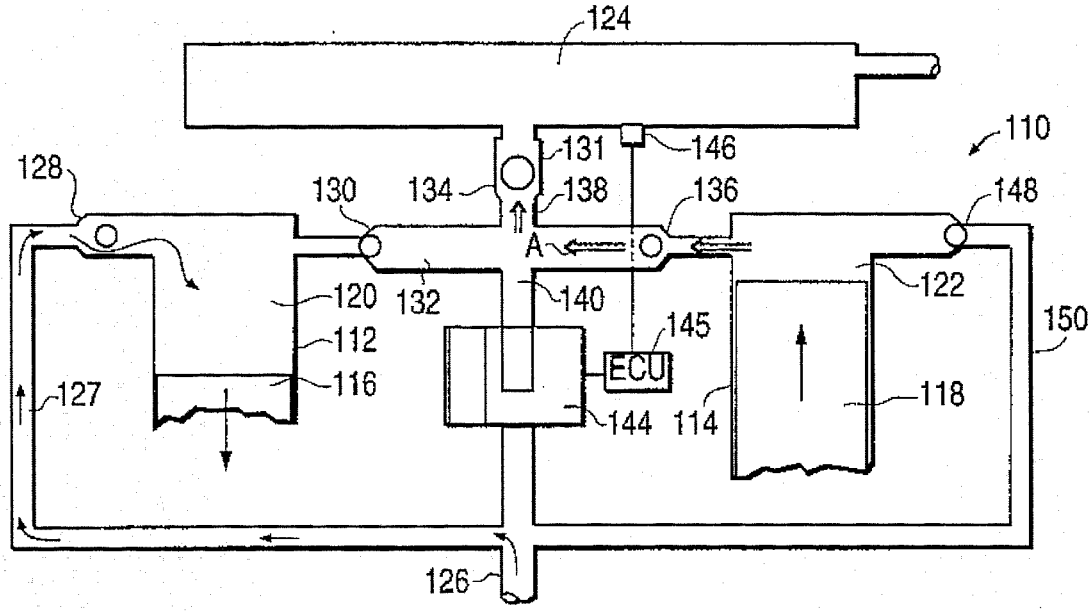
FIGS. 1B, 2B, 3B and 4B are schematic illustrations of an alternative embodiment of the high pressure pumping system in accordance with an alternative embodiment of the present invention illustrating the cyclic operation thereof.

With the cycle of operation illustrated in FIG. 1B, the electronic control unit 145 has determined that the fluid pressure within the accumulation chamber 124 has fallen below the predetermined optimum value in response to the pressure sensed by sensor 146 and consequently the electronic control unit 145 has positioned the control valve 144 in the closed position. Once in this position, fluid within the common chamber 132 is rapidly pressurized to a point greater than that of the fluid pressure within the accumulation chamber 124 thus displacing the check valve 134 and permitting pressurized fluid pressurized within the common passage 132 and pumping chamber 122 to pass into the accumulation chamber 124. During such sequence, a check valve 148 prevents pressurized fluid from passing from the pumping chamber 122 into supply passage 150, while check valve 130 prevents the flow of high pressure fluid into pumping chamber 120.

Figure 2B:
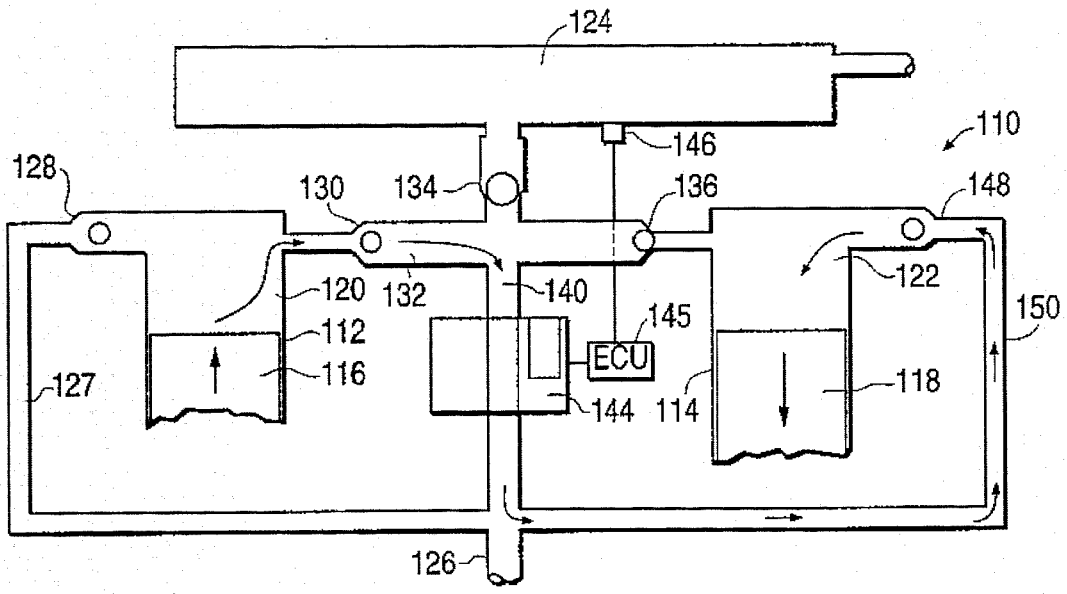

Referring now to FIG. 2B, in response to the fluid pressure sensed by the pressure sensor 146 the electronic control unit 145 has determined that the fluid pressure within accumulation chamber 124 is at least as high as the predetermined optimum value. Accordingly, the control valve 144 is moved to the open position. When in this position, continued upward movement of the pumping element 116 of pumping unit 112 passes fluid past check valve 130 and into the common chamber 132. Because this fluid pressure is less than that of the fluid pressure in the accumulation chamber 124, the check valve 134 remains in place and fluid passing into the common chamber 132 passes through passage 140 and the control valve 144 and is directed into supply passage 150. In doing so, the fluid is supplied to the pumping unit 114 past check valve 148 during the downward stroke of the pumping element 118. Because the pressure of the fluid within the pumping chamber 120 is greater than that of the fluid supplied through passage 126, the check valve 128 remains seated such that no fluid is passed through passage 127.

Figure 3B:
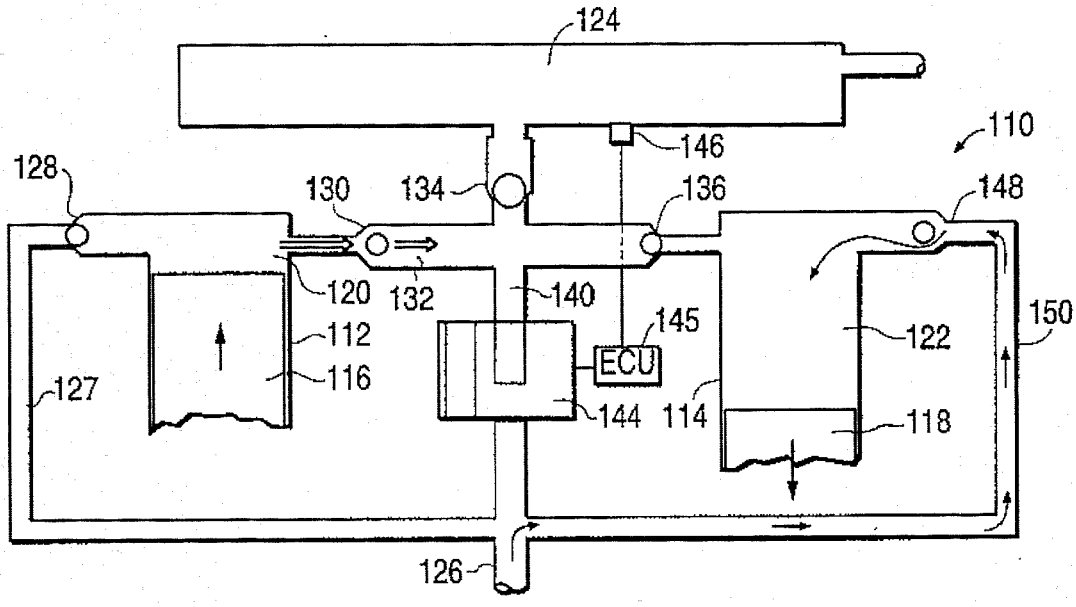
Figure 4B:
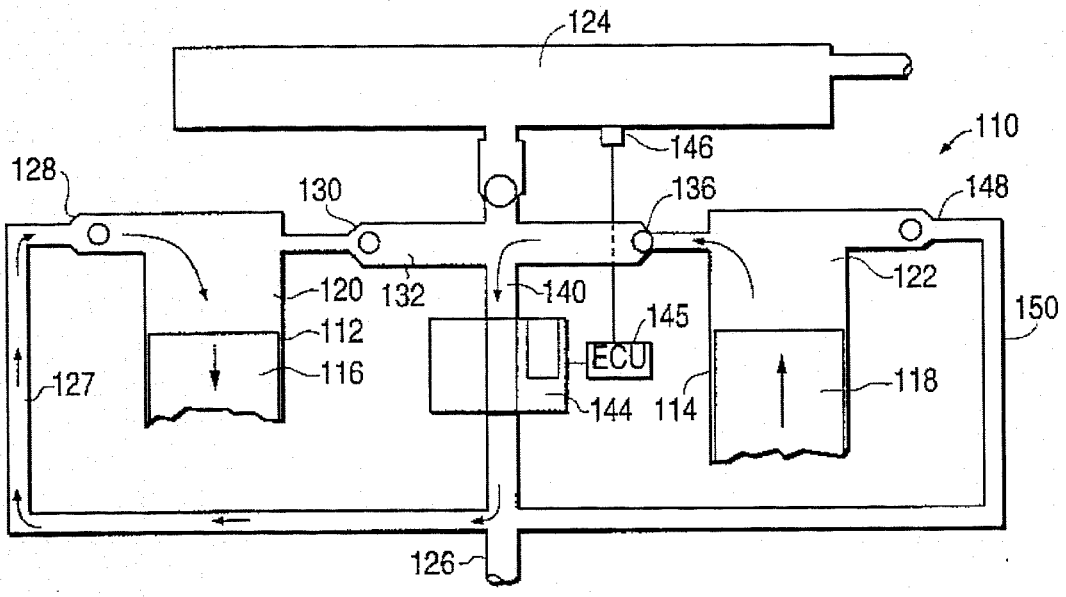

With reference to FIG. 3B, if it is determined by the electronic control unit 145 that the pressure in the accumulation chamber 124 has fallen below the optimum value in response to the fluid pressure sensed by pressure sensor 146 during the upward stroke of pumping element 116, the control valve 144 is displaced, in response to a signal from the electronic control unit 145, to the closed position thus causing the fluid pressure within the common chamber 132 and pumping chamber 120 to quickly rise above that of the accumulation chamber 124 consequently displacing the check valve 134 and permitting the passage of pressurized fluid from the common chamber 132 to the accumulation chamber 124. In doing so, check valves 128 and 136 are maintained in their closed position closing off fluid communication between pumping unit 112 and pumping unit 114. Similarly, once the control valve 144 is closed, fluid supplied by the supply pump is passed through passages 126 and 150 past check valve 148 and into the pumping chamber 122. Because the pumping units 112 and 114 are 180° out of phase, the pumping element 116 will reach top dead center at the same time as the pumping element 118 reaches bottom dead center, thus downward movement of the pumping element 116 will relieve the pressure within the pumping chamber 120 while upward movement of the pumping element 118 will increase the fluid pressure within the pumping chamber 122. At this instance, the control valve 144 may remain in the closed position which would permit pressurized fluid in the pumping chamber 122 to fill the common chamber 132 and subsequently be passed to the accumulation chamber 124 or the control valve 144 may be moved to the position illustrated in FIG. 4B in response to a signal from the electronic control unit 145 which permits the passage of fluid therethrough. That is, if the electronic control unit 145 determines that the fluid pressure within the accumulation chamber 124 is at or exceeds the predetermined optimum value, the control valve 144 will be positioned as illustrated in FIG. 4B thus causing check valve 130 and 148 to close, and check valves 128 and 136 to open permitting the flow of fluid from pumping chamber 122 to pumping chamber 120 by way of the common chamber 132, passage 140 and passage 127. Continued upward movement of the pumping element 118 of pumping unit 114 and continued downward movement of the pumping element 116 of pumping unit 112 continues to permit the passage of fluid from the pumping chamber 122 to pumping chamber 120 until either the control valve 144 is displaced to the closed position response to a pressure sense by pressure sensor 146 or the pumping element 116 reaches bottom dead center and the pumping element 118 reaches top dead center at which time the check valves would move to the position illustrated in FIG. 2B and fluid would pass from the pumping chamber 120 of the pumping unit 112 to the pumping chamber 122 of pumping unit 114. Once the electronic control unit determines that the fluid pressure in the accumulation chamber 124 sensed by the pressure sensor 146 less than that of the predetermined optimum value, the control valve will move to the position illustrated in either FIG. 1B or 3B resulting in the passage of pressurized fluid to the accumulation chamber 124 by either pumping unit 112 or pumping unit 114 whichever has a rising pumping element.

As with the previously discussed embodiment, while the above noted operation of the pumping system operates the control valve 144 in response to a predetermined low pressure limit of the accumulation chamber 124, the electronic control unit may alternatively command the control valve to open and close in response to other desirable factors. For instance, in a fuel system where a small amount of fuel will be removed from the accumulation chamber during every injection event as previously discussed. Accordingly, in such a fuel system, the pumping units will normally pump at least a portion of their full volume on each stroke with the electronic control unit 145 being designed to alter the portion of the pump volume which is to be delivered to the accumulation chamber by controlling control valve 144 based on an average accumulation chamber pressure. As the average pressure falls below a target average pressure, a proportionately larger amount of fuel will be pumped to the accumulation chamber 124.

With such a system, by using a pressure balanced control valve, the control valve 144 can be opened and closed during any portion of the pumping event, as discussed hereinabove. That is, the control valve 144 can be closed early in the pumping event so that pumping begins on a low velocity portion of the pumping stroke which reduces instantaneous loading of the system, or the control valve 144 can be closed late in the pumping event such that pumping ends on a low velocity portion of the pumping stroke thus reducing system noise. Again, the particular timing for closing of the control valve will depend first on the amount of fuel required to achieve the desired pressure within the accumulation chamber and second on the operating characteristics desired.

While the operation of the present invention has been described with reference to the schematic illustrations of FIGS. 1–4, the practical construction of the pumping system illustrated in FIGS. 1B, 2B, 3B and 4B will now be described in detail with reference to FIGS. 5–7.

Figure 5:
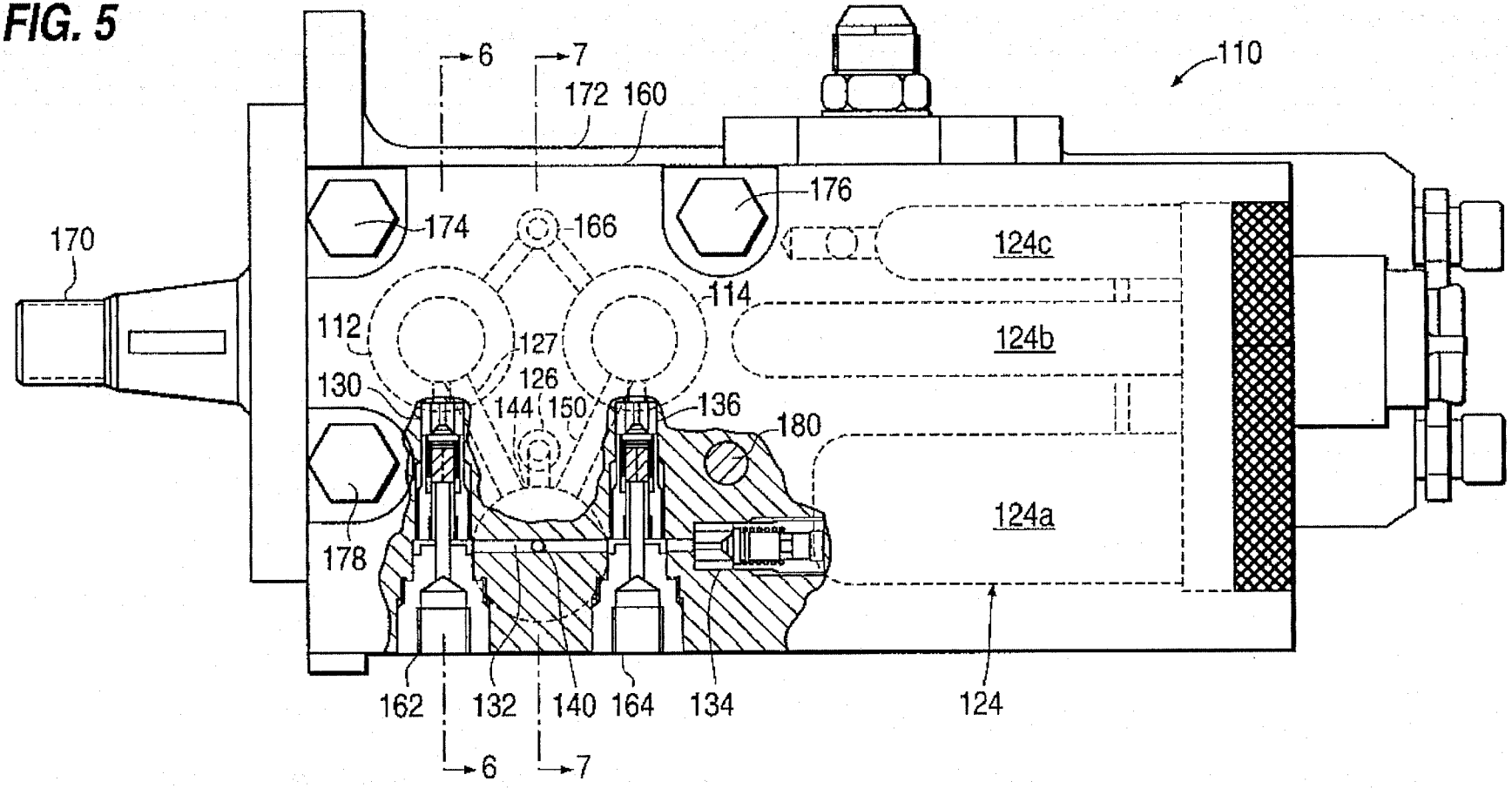
FIG. 5 is a partial cross-sectional view of the high pressure pumping system illustrated in FIGS 1B, 2B, 3B and 4B.

FIG. 5 illustrates a partial cross-sectional view of the pumping unit 110, in its practical state, which includes pumping units 112 and 114 of the type in-line pumping systems which may take the form of the pumping system disclosed in Copending U.S. application Ser. No. 057,489, filed May 6, 1993 and assigned to the assignee of the subject invention, the disclosure of which is hereby incorporated herein by reference. The pumping system is formed of a pump housing 172 which houses pumping units 112 and 114 as well as a pump housing head 160 which receives an upper portion of the pumping units 112 and 114 and includes the accumulation chamber 124 formed by a series of interconnected cavities **124*a*, 124*b* and 124*c*. The accumulation chamber 124 being connected to the common chamber 132 by way of check valve 134. Similarly, each pumping chamber of the respective pumping units 112 and 114 are fluidically connected to the common chamber 132 by way of check valves 130 and 136. Because the check valves are positioned within the pump housing head 160 which is formed of a one piece construction, plugs 162 and 164 are used to position check valves 130 and 136 and to facilitate assembly of the unit. Additionally, passage 140 is provided between the common chamber 132 and control valve 144 which is likewise fluidically connected to each of pumping units 112 and 114 by way of passages 127 and 150, respectively. Further, because in the practical operation of the system, some leakage occurs about the pumping units 112 and 114 drain 166** is provided for draining any leakage back to the fluid supply tank.

As discussed hereinabove, the pumping units 112 and 114 are of the type discussed in Copending application Ser. No. 057,489 and are driven by cams (not shown) having a predetermined cam profile which are rotated by a rotary shaft 170. The accumulation chamber 124 is provided in the pump housing head 160 along with check valves 130, 134 and 136 as well as control valve 144. As mentioned hereinabove a portion of the pumping units 112 and 114 are accommodated within the housing 160 as illustrated in FIG. 6 while the remaining portion of the pumping units as well as the cams and rotary drive shaft are housed in the pump housing 172. The pump housing and pump housing head are bolted to one another by way of anchor bolts 174, 176, 178 and 180 in a conventional manner with seals being provided therebetween to minimize any leakage between the housing and head.

Figure 6:
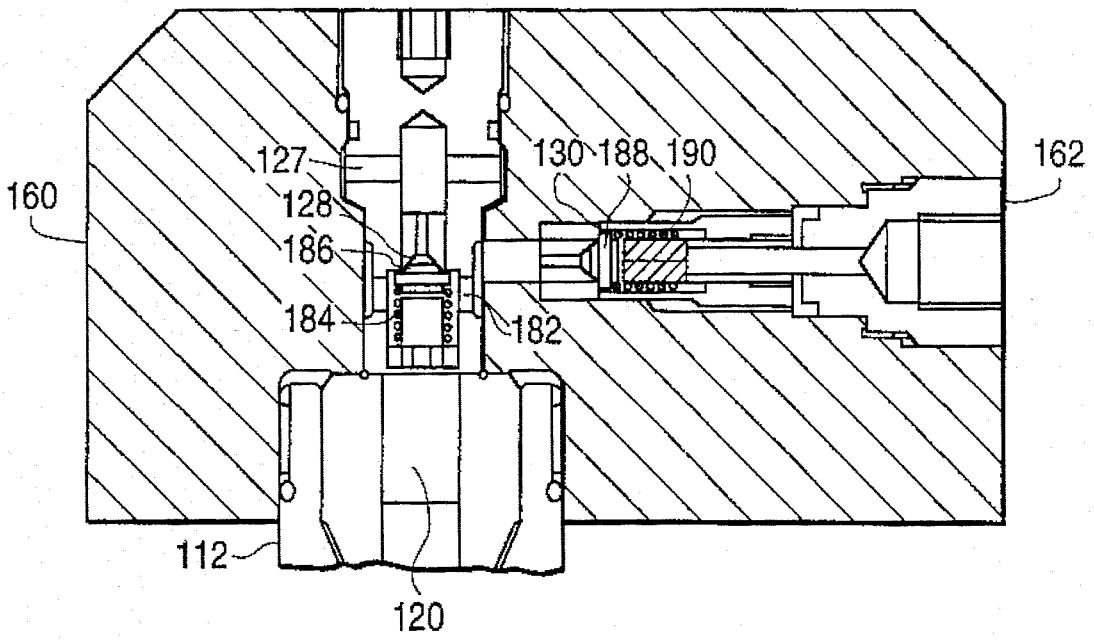
FIG. 6 is a cross-sectional view taken along line 6—6 of FIG. 5.

Referring now to FIG. 6, the pumping unit 112 receives fluid which passes through the check valve 128 in the pumping chamber 120. Fluid within the pumping chamber 120 is forced through the passage 182 and past check valve 130 where the fluid is received within the common chamber 132 and either pressurized and passed to the accumulation chamber 124 or passed by way of passage 140 and 150 to the second pumping unit 114. As can be seen from FIG. 6, the check valve 128 includes compression spring 184 which forces the valve element 186 of the check valve 128 towards the closed position. Fluid is supplied to the passage 127 from either the low pressure fluid supply or the pumping unit 114 which is subsequently passed into the pumping chamber 120. Similarly, the check valve 130 includes valve element 188 which is biased in a closed position by compression spring 190 which permits the passage of fluid to the common chamber 132.

Figure 7:
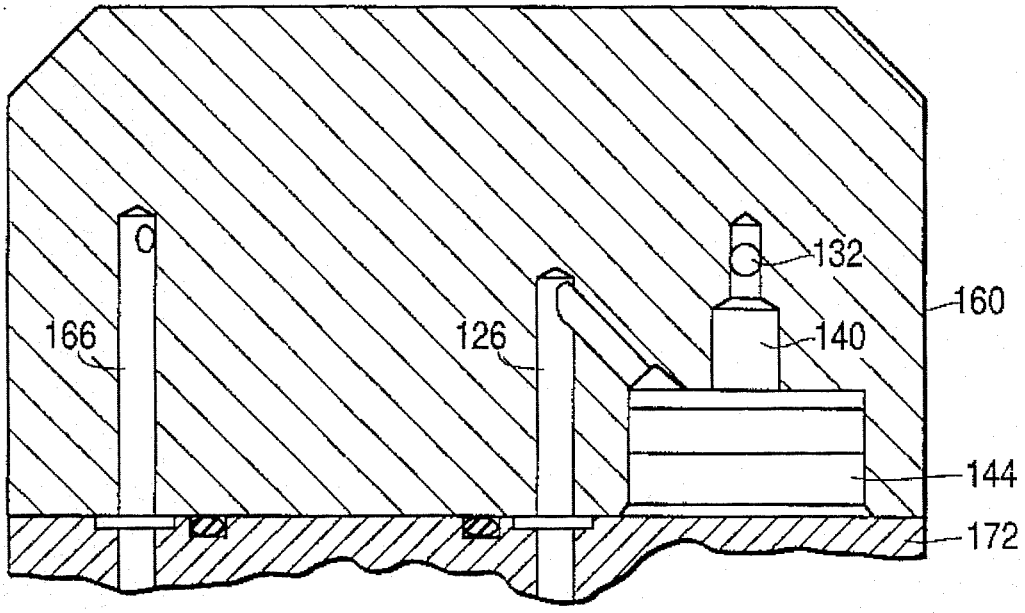
FIG. 7 is a cross-sectional view taken along line 7—7 of FIG. 5.

Referring now to FIG. 7, the control valve is illustrated as being positioned within the head 160 and adjacent the housing 172. The control valve 144 is fluidically connected to the supply passage 126 as described hereinabove and the common chamber 132. As discussed hereinabove, when the control valve 144 is in the open condition, fluid is permitted to pass through passage 140 to one of the pumping units 112 or 114 through passages 127 or 150. Similarly, when the control valve 144 is closed, continued upward movement of pumping element 116 or 118 causes an increase in the pressure of the fluid within the common chamber 132 which then displaces and passes the check valve 134 and is expelled into the accumulation chamber 124. While the foregoing description depicts one practical construction of the present invention, it is clear that the elements which constitute the invention may be arranged in a number of configurations while still achieving the overall objective of the present invention.

As can be seen from the foregoing, a high pressure pumping system for fuel injection systems is achieved in accordance with the present invention. Moreover, a high pressure pumping system is achieved by incorporating only a single control valve for multiple pumping units such that the pumping units can either operate in unison with one another or independently from one another.

While the present invention has been described with reference to preferred embodiments, it will be appreciated by those skilled in the art that the invention may be practiced otherwise than as specifically described herein without departing from the spirit and scope of the invention. It is, therefore, to be understood that the spirit and scope of the invention be limited only by the appended claims.

INDUSTRIAL APPLICATION

The above discussed high pressure pumping system may be adapted to any environment wherein it is desired to maintain a fluid at a predetermined optimum high pressure within an accumulation chamber for subsequent discharge in a related system. The present invention is particularly useful in maintaining fuel at a predetermined optimum high pressure within an accumulation chamber for subsequent injection at such high pressure into the cylinders of an internal combustion engine.

I claim:

1. A variable displacement high pressure pump for pumping fluid at a high pressure to an accumulation chamber comprising;

a low pressure pumping means for supplying fluid at a low pressure;

a first high pressure pumping means for receiving the low pressure fluid through an inlet therein and selectively delivering the supplied fluid to the accumulation chamber at a high pressure greater than said low pressure;

a second high pressure pumping means for receiving the low pressure fluid through an inlet therein and selectively delivering the supplied fluid to the accumulation chamber at a high pressure greater than said low pressure;

a common fluid passage in fluid communication with each of said first and second high pressure pumping means for permitting the flow of fluid from one of said first and second high pressure pumping means to the other of said first and second high pressure pumping means; and a valve means positioned in said common fluid passage for selectively blocking the flow of fluid between said first and second high pressure pumping means;

wherein one of said first and second high pressure pumping means delivers fluid at said high pressure to the accumulation chamber when said valve means blocks the flow of fluid between said first and second high pressure pumping means, each of said first and second high pressure pumping means including a first outlet for passing high pressure fluid to the accumulation chamber and a second outlet for passing fluid to said common fluid passage.

2. The pump as defined in claim 1, wherein a predetermined fluid pressure is maintained in the accumulation chamber.

3. The pump as defined in claim 2, wherein said valve means is a pressure balanced electronically actuated solenoid valve.

4. The pump as defined in claim 3, further comprising a pressure sensing means for sensing a pressure within the accumulation chamber, wherein said valve means is actuated in response to a pressure sensed by said pressure sensing means which is less than a predetermined lower limit pressure.

5. The pump as defined in claim 2, wherein said predetermined fluid pressure in the accumulation chamber is in a range of 5,000 psi to 30,000 psi.

6. The pump as defined in claim 5, wherein said predetermined fluid pressure in the accumulation chamber is in a range of 16,000 psi to 22,000 psi.

7. The pump as defined in claim 1, wherein at least a portion of the fluid received in each of said high pressure pumping means is delivered to the accumulation chamber during each stroke of a pumping element within each high pressure pumping means.

8. The pump as defined in claim 7, further comprising a pressure sensing means for sensing a pressure within the accumulation chamber, wherein said valve means is actuated in response to a pressure sensed by said pressure sensing means which is less than a predetermined average pressure.

9. The pump as defined in claim 8, wherein said valve means is a pressure balanced electronically actuated solenoid valve.

10. The pump as defined in claim 7, wherein each of said pumping elements are driven by a cam means having a predetermined cam profile, wherein said valve means is closed during one of an initiation of a pumping cycle such that pumping begins on a low velocity portion of said cam profile and a termination of the pumping cycle such that pumping ends on a low velocity portion of said cam profile.

11. A pumping system for maintaining a high fluid pressure within an accumulation chamber comprising;

a plurality of high pressure pumps for delivering fluid to the accumulation chamber at a high pressure;

fluid supply means for supplying fluid at a low pressure to an inlet of each of said plurality of high pressure pumps;

a common fluid chamber fluidically connected to an outlet of each of said high pressure pumps; said common fluid chamber having a first outlet fluidically connected to the accumulation chamber and a second outlet fluidically connected to each inlet of said plurality of high pressure pumps; and a valve means positioned in said second outlet for selectively blocking the flow of fluid from said common fluid chamber to said plurality of high pressure pumps;

wherein fluid is delivered at the high pressure to the accumulation chamber when the valve means blocks the flow of fluid from the second outlet of said common fluid chamber.

12. The pump as defined in claim 11, wherein a predetermined fluid pressure is maintained in the accumulation chamber.

13. The pump as defined in claim 12, wherein said valve means is a pressure balanced electronically actuated solenoid valve.

14. The pump as defined in claim 13, further comprising a pressure sensing means for sensing a pressure within the accumulation chamber, wherein said valve means is actuated in response to a pressure sensed by said pressure sensing means which is less than a predetermined lower limit pressure.

15. The pump as defined in claim 12, wherein said predetermined fluid pressure in the accumulation chamber is in a range of 5,000 psi to 30,000 psi.

16. The pump as defined in claim 15, wherein said predetermined fluid pressure in the accumulation chamber is in a range of 16,000 psi to 22,000 psi.

17. The pump as defined in claim 11, wherein there are first and second high pressure pumps, with said first and second high pressure pumps operating 180° out of phase with one another.

18. The pump as defined in claim 17, further comprising a common fluid passage in fluid communication with each of said first and second high pressure pumps for permitting the flow of fluid from one of said first and second high pressure pumps to the other of said first and second high pressure pumps.

19. The pump as defined in claim 18, wherein said common fluid chamber includes at least two inlets for receiving fluid from each of said first and second high pressure pumps, a first outlet for passing fluid to said common passage and a second outlet for passing fluid to the accumulation chamber.

20. The pump as defined in claim 19, wherein fluid in said common chamber is passed to said common passage when said valve means is not blocking the flow of fluid, and fluid in said common chamber is passed to the accumulation chamber at said high pressure when said valve means is blocking the flow of fluid through said common passage.

21. The pump as defined in claim 11, wherein at least a portion of the fluid received in each of said high pressure pumping means is delivered to the accumulation chamber during each stroke of a pumping element within each high pressure pumping means.

22. The pump as defined in claim 21, further comprising a pressure sensing means for sensing a pressure within the accumulation chamber, wherein said valve means is actuated in response to a pressure sensed by said pressure sensing means which is less than a predetermined average pressure.

23. The pump as defined in claim 22, wherein said valve means is a pressure balanced electronically actuated solenoid valve.

24. The pump as defined in claim 21, wherein each of said pumping elements are driven by a cam means having a predetermined cam profile, wherein said valve means is closed during one of an initiation of a pumping cycle such that pumping begins on a low velocity portion of said cam profile and a termination of the pumping cycle such that pumping ends on a low velocity portion of said cam profile.

25. The pump as defined in claim 24, wherein said common fluid chamber includes at least two inlets for receiving fluid from each of said first and second high pressure pumping means, a first outlet for passing fluid to said common passage and a second outlet for passing fluid to the accumulation chamber.

26. The pump as defined in claim 25, wherein fluid in said common chamber is passed to said common passage when said valve means is not blocking the flow of fluid, and fluid in said common chamber is passed to the accumulation chamber at said high pressure when said valve means is blocking the flow of fluid through said common passage.

27. A variable displacement high pressure pump for pumping fluid at a high pressure to an accumulation chamber comprising;

a low pressure pumping means for supplying fluid at a low pressure;

a first high pressure pumping means for receiving the low pressure fluid through an inlet therein and selectively delivering the supplied fluid to the accumulation chamber at a high pressure greater than said low pressure;

a second high pressure pumping means for receiving the low pressure fluid through an inlet therein and selectively delivering the supplied fluid to the accumulation chamber at a high pressure greater than said low pressure;

a common fluid passage in fluid communication with each of said first and second high pressure pumping means for permitting the flow of fluid from one of said first and second high pressure pumping means to the other of said first and second high pressure pumping means;

a common fluid chamber fluidically connected to each of said first and second high pressure pumping means and said common fluid passage; and a valve means positioned in said common fluid passage for selectively blocking the flow of fluid between said first and second high pressure pumping means;

wherein one of said first and second high pressure pumping means delivers fluid at said high pressure to the accumulation chamber when said valve means blocks the flow of fluid between said first and second high pressure pumping means.

* * * * *